United States Patent [19]

Sciortino

[11] 4,289,269

[45] Sep. 15, 1981

[54] UNIVERSAL FUNNEL AND MOUNTING BRACKET FOR COIN RECEPTACLES OF COIN OPERATED MACHINES

[76] Inventor: August M. Sciortino, 1838 Weeg Way, Park Ridge, Ill. 60068

[21] Appl. No.: 41,755

[22] Filed: May 23, 1979

Related U.S. Application Data

[63] Continuation-in-part of Ser. No. 13,370, Feb. 23, 1979, abandoned.

[51] Int. Cl.[3] ..... G07B 15/00

[52] U.S. Cl. ..... 232/16; 248/94

[58] Field of Search ..... 232/15, 16, 55–66, 232/43.2; 248/201, 94; 109/51

[56] References Cited

U.S. PATENT DOCUMENTS

| | | | |
|---|---|---|---|
| 369,980 | 9/1887 | Bruen | 248/94 X |
| 1,396,939 | 11/1921 | Miller | 248/201 X |
| 2,047,876 | 7/1936 | Knepp | 248/94 |
| 3,033,507 | 5/1962 | Brill | 248/201 |
| 3,677,461 | 7/1972 | Nitschneider et al. | 232/15 |
| 3,807,627 | 4/1974 | Nitschneider | 232/66 X |
| 4,177,920 | 12/1979 | Sciortino | 232/16 |

*Primary Examiner*—Roy D. Frazier
*Assistant Examiner*—Peter A. Aschenbrenner
*Attorney, Agent, or Firm*—Silverman, Cass & Singer, Ltd.

[57] ABSTRACT

For use with coin operated machines having mounting plates carrying a coin drop opening adapted to pass coins therethrough into a coin receptacle mounted therebelow, in combination; a universal funnel and mounting bracket capable of being secured to any one of different mounting plates independent of the location of the coin drop openings carried thereby, thereby to guide coins to said coin receptacle, said funnel having a frustoconical configuration, open at opposite ends and having a row of spaced holes formed in the funnel walls about the full circumference thereof and at least a pair of angled clip members fastened both to the plate and to the funnel through selected opposite pairs of said holes.

6 Claims, 3 Drawing Figures

FIG. 1
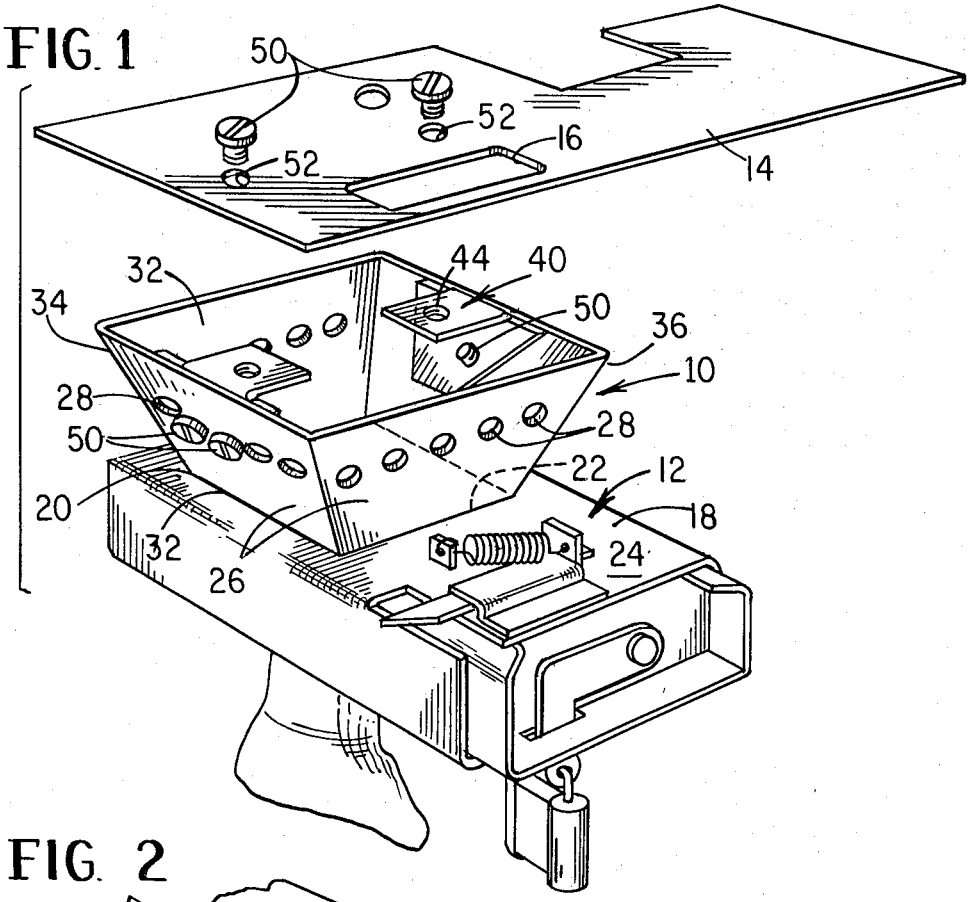
FIG. 2
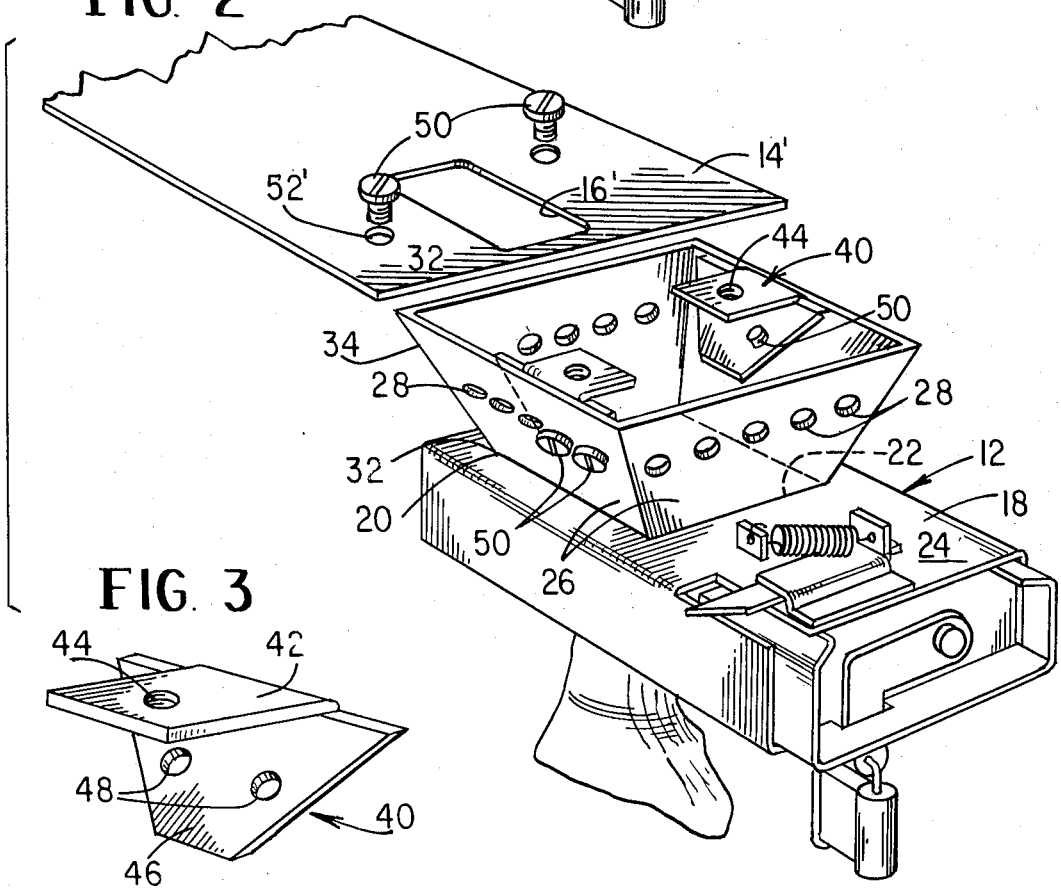
FIG. 3

UNIVERSAL FUNNEL AND MOUNTING BRACKET FOR COIN RECEPTACLES OF COIN OPERATED MACHINES

CROSS-REFERENCE TO RELATED APPLICATIONS

This application is a continuation-in-Part of my pending patent application Ser. No. 13,370 filed Feb.23, 1979, now abandoned.

This invention relates generally to coin operated devices which include a plate member having a coin drop opening formed therein and more particularly, provides a funnel like defining frame adapted to carry a coin receptacle and be secured to said plate in opening-surrounding condition independent of the location thereof relative to the plate, thus enabling the coin receptacle carried by said frame to be installed in any one of a plurality of different coin operated machines having plates with differently located coin drop openings.

Coin operated machines all require some type of removably installable coin receptacle. Coin operated machines originating from different manufacturers and for different purposes are provided with plate means of differing planar configuration. Coin drop openings are carried by the plate means located to feed into different locations relative to the coin receiving enclosure. Mounting brackets are provided, including a mounting for carrying the coin receptacle. The plate means include a coin drop opening. The location of such opening on the plate means differs from manufacturer to manufacturer. This requires construction of adaptor means between the mounting for the coin receptacle and the coin receptacle to guide the coins to said receptacle.

Different adaptors have to be constructed for machines of differing origin, adding to the cost. Often the adaptors include a funnel which must be individually tailored to the specific machine with which its use is required.

Thus there is a considerable need for a universal type funnel and mounting bracket system therefor suitable for use with most available types of coin operated machines of plural manufacturing origin and function.

SUMMARY OF THE INVENTION

A universal funnel and mounting bracket, the funnel formed of at least four panels joined at their ends to define a frustoconical frame having a wide entrance, each panel having identically but oppositely directed diagonal ends and parallel unequal length longitudinal sides, said panels having a row of spaced holes formed therein, at least a pair of angled clip members, fastening means for securing said clips respectively to a pair of said panels for securing the frame to the coin receptacle mounting plate of said coin operated machine with the frame surrounding the coin drop opening thereof independent of the location of the coin drop opening thereof.

BRIEF DESCRIPTION OF THE DRAWING

FIG. 1 is an exploded perspective view of a coin receptacle having the funnel and mounting bracket according to the invention shown in the process of being installed upon a mounting plate provided in a coin operated machine;

FIG. 2 is a detail illustrating the disposition of the fastening means on the funnel for mounting of same upon a different mounting plate; and FIG. 3 is a detail of the clip members used to couple the funnel to the mounting plate.

DESCRIPTION OF THE PREFERRED EMBODIMENT

Referring now to the drawing, in FIG. 1 there is illustrated a locked covered coin receptacle, the funnel 10 constructed according to the invention and installed upon mounting bracket adaptor 12. The adaptor 12 is to be secured to a mounting plate 14 carried by a coin operated machine, said plate carrying a coin-drop opening 16. These mounting plates 14 are individual to each type and manufacturing origin of coin operated machines and are different both as to permimetric configuration and the location of a coin drop opening formed therein from machine to machine.

The funnel of the invention enables the mounting bracket for a coin receptacle to be installed upon any mounting plate independent of the perimetric configuration thereof or the location thereon of the coin drop opening carried thereby. Therefore, one can describe the resultant combination as a universal mounting bracket for coin receptacles.

The funnel 10 preferably is weldably secured to a channeled member 18 with the narrow opening 20 about the coin receiving opening 22 formed in channel wall 24 of the channeled member 18. The funnel 10 is of frustoconical configuration defined by four identical side panels 26, each of which carries a row of spaced holes 28 so that there is a continuous row of holes 28 about said frame, an equal number of holes 28 formed in each panel. Here, there are five holes 28 carried by each panel. Each panel has a pair of longitudinal side edges 30 and 32, the length of edge 30 being less than the length of edge 32. A pair of opposite diagonal side edges 34,36 are provided. Edges 34,36 are equal in length but are oppositely directed. The angle being 30°, two of the panels 26 may be integral along one side edge thereof and are formed together by bending a larger panel so that the longitudinal edges of said panel are oriented at a 90° angle, one panel relative to the other. Two of the subassembled panels are secured as by welding to define the funnel 10.

A pair of clip members 40 are provided. Each clip has a base portion 42 carrying threaded passage 44 and a leg portion 46 having a configuration similar to the perimetric configuration of the panels 26, the leg portion oriented relative to the base to define an angle the same as the angle at which the panels are disposed relative a horizontal plane taken parallel to the wide opening of said funnel 10. The leg portion 46 carries two threaded passageways 48 located to be aligned with a pair of the holes 28 when the base 42 is arranged horizontally flush with the open end of the funnel 10. Suitable screws are employed to fasten the clips 40 to the frame 14 via mounting holes 52 so that the base portion 42 is arranged flush with the mouth or entrance to the funnel 10. A pair of identical clips 40 is provided for fastening on opposite sides of the funnel 10. The base 42 is fastened to the mounting plate to position the funnel 10 at a location where the coin drop opening 16 carried thereby is within the ambit of the wider entrance of the funnel 10. With five holes in each panel, there are at least four different positions for fastening the clips to the funnel to accommodate different locations of the coin drop opening in the mounting plates of different coin operated machines.

In FIG. 2 a different plate 14' is provided where the location of the coin drop 16' is different from that of plate 14; likewise, the location of mounting holes 52'. The location of clips 40 thus is changed. Preferably, the locations of clips 40 relative each other are selected to be symmetrical, one relative to the other for balance.

The arrangement of the holes 28 in the funnel walls permit sixteen different combinations, noting that the clips should be installed on opposite panels. The installation of the funnel 10 can be accomplished easily and securely to any plate regardless of the location of the coin drop opening thereon, said opening being surrounded by the mouth or entrance to the funnel 10.

Variations can be made to the funnel of the invention without departing from the spirit and scope of the invention as claimed in the claims appended hereto.

What I claim is:

1. A funnel for installation upon a mounting plate of a coin operated machine comprising, a frame member having at least four substantially identical panels of frustoconical perimetric configuration, said panels being secured end to end to define an entrance and a smaller opening opposite thereto, at least a pair of opposite panels each carrying at least one aperture spaced inwardly of the entrance, apertured clip means and fastening means for securing said clip means to each of said opposite panels via said apertures, said clip means including a base oriented for positioning flush with said entrance with an angled leg secured to said panels flush to the surface thereof whereby to locate said entrance in condition to receive coins.

2. The structure as claimed in claim 1 in which the mounting plate carries at least one coin drop opening said funnel is capable of being secured on the mounting plate with said entrance aligned with the coin drop opening.

3. The structure as claimed in claim 1 in which there is a continuous row of apertures about the frame defined by said panels, said clip means being secured to the said panels in selected adjacent pairs of said apertures in each of said opposite pair of panels.

4. The structure as claimed in claim 1 in which said funnel is secured to a channeled mounting bracket carrying a window with the smaller opening surrounding said window, said mounting bracket capable of receiving a covered coin receptacle therein within the channel thereof.

5. A channeled mounting bracket for mounting on an apertured mounting plate, said bracket capable of receiving a covered coin receptacle and having a window alignable with said coin receptacle, said mounting bracket having a funnel defining frame secured thereto, said funnel having an entrance adapted to be mounted within a coin controlled machine to place the entrance aligned and communicating with said coin drop opening thereof, said funnel frame having a row formed of a plurality of spaced apertures formed therein along the circumference of said frame, angled clip means adapted to be secured to said frame in selected ones of said apertures to position said frame secured in condition to guide coins to said receptacle.

6. The bracket as claimed in claim 5 in which the row of apertures extends about said frame.

* * * * *